US009797055B2

(12) United States Patent
Sato et al.

(10) Patent No.: US 9,797,055 B2
(45) Date of Patent: Oct. 24, 2017

(54) METAL COATING FILM FORMATION DEVICE AND METHOD

(71) Applicant: TOYOTA JIDOSHA KABUSHIKI KAISHA, Toyota-shi, Aichi (JP)

(72) Inventors: Yuki Sato, Nagakute (JP); Motoki Hiraoka, Toyota (JP); Hiroshi Yanagimoto, Miyoshi (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 111 days.

(21) Appl. No.: 14/976,572

(22) Filed: Dec. 21, 2015

(65) Prior Publication Data

US 2016/0186353 A1 Jun. 30, 2016

(30) Foreign Application Priority Data

Dec. 26, 2014 (JP) ..... 2014-265951

(51) Int. Cl.

| | |
|---|---|
| ***C25D 5/06*** | (2006.01) |
| ***C25D 17/14*** | (2006.01) |
| ***C25D 3/02*** | (2006.01) |
| ***C25D 3/00*** | (2006.01) |
| ***C25D 17/00*** | (2006.01) |

(Continued)

(52) U.S. Cl.

CPC ..... *C25D 3/02* (2013.01); *C25D 3/00* (2013.01); *C25D 5/06* (2013.01); *C25D 17/00* (2013.01); *C25D 17/10* (2013.01); *C25D 17/12* (2013.01); *C25D 17/14* (2013.01); *C25D 3/12* (2013.01); *C25D 3/38* (2013.01); *C25D 5/08* (2013.01)

(58) Field of Classification Search

CPC ..... C25D 5/06; C25D 17/14

See application file for complete search history.

(56) References Cited

U.S. PATENT DOCUMENTS 4,326,930 A * 4/1982 Nagel ..... C25B 9/10 205/161

6,277,261 B1 * 8/2001 Divisek ..... C25B 9/10 205/114

(Continued)

FOREIGN PATENT DOCUMENTS

CN 104011269 A 8/2014

JP 2004353014 A 12/2004

(Continued)

*Primary Examiner* — Bryan D. Ripa

(74) *Attorney, Agent, or Firm* — Sughrue Mion, PLLC

(57) ABSTRACT

Provided is a metal coating film formation device capable of forming a film using a simple device configuration and in a short time, and capable of performing the formation of a film of metal coating continuously for a long period. A film formation device 1A is provided with an anode 11, a solid electrolyte film 13 disposed between the anode 11 and the base material B, and a power supply unit 16 that applies a voltage between the anode 11 and the base material B. The anode 11 is a non-porous anode comprising the same metal as the metal of the metal coating. Between the anode 11 and the solid electrolyte film 13, a porous material 14 is disposed in contact with the anode 11 and the solid electrolyte film 13. The porous material 14 includes a plurality of pores providing communication between the anode 11 and the solid electrolyte film 13 and being supplied with a metal solution L.

8 Claims, 6 Drawing Sheets

(51) Int. Cl.

| | |
|---|---|
| ***C25D 17/10*** | (2006.01) |
| ***C25D 17/12*** | (2006.01) |
| *C25D 3/12* | (2006.01) |
| *C25D 3/38* | (2006.01) |
| *C25D 5/08* | (2006.01) |

(56) References Cited

U.S. PATENT DOCUMENTS

| | | | | |
|---|---|---|---|---|
| 9,115,438 | B2 * | 8/2015 | Simon | C25D 3/02 |
| 2005/0051437 | A1 | 3/2005 | Kurashina et al. | |
| 2006/0113192 | A1 | 6/2006 | Kurashina et al. | |
| 2014/0224662 | A1 * | 8/2014 | Arumugam | C25D 5/06 205/93 |
| 2015/0014178 | A1 | 1/2015 | Hiraoka et al. | |
| 2015/0329982 | A1 * | 11/2015 | Miura | C25D 7/0607 205/98 |

FOREIGN PATENT DOCUMENTS

| | | | | |
|---|---|---|---|---|
| JP | 2005133187 | A | 5/2005 | |
| JP | 2012219362 | A * | 11/2012 | C25D 17/00 |
| JP | 2014-185371 | A | 10/2014 | |

* cited by examiner

METAL COATING FILM FORMATION DEVICE AND METHOD

BACKGROUND

Technical Field

The present invention relates to a film formation device and method for forming a film of metal coating on a surface of a base material, particularly to a metal coating film formation device and method whereby a film of metal coating can be formed in a preferred manner by applying a voltage between an anode and the base material.

Background Art

Conventionally, a film of metal coating may be formed by causing metal ion deposition on the surface of a base material. Examples of such metal coating film formation technology that have been proposed include a plating process for metal coating film formation, such as electroless plating process, and a PVD method for metal coating film formation, such as sputtering.

However, when a plating process such as electroless plating process is performed, washing is required after the plating process, and waste liquid after the washing needs to be treated. When a PVD method such as sputtering is used for film formation on the base material surface, internal stress develops in the metal coating, limiting the extent to which the film thickness can be increased. Particularly, in the case of sputtering, film formation is only possible in high vacuum.

In view of the above circumstance, a metal coating film formation device has been proposed which is provided with, for example, an anode; a solid electrolyte film disposed between the anode and a base material (cathode); and a power supply unit for applying a voltage between the anode and the cathode (base material) (see Patent Document 1, for example).

In the film formation device according to Patent Document 1, the anode comprises a porous material that admits the passage of a solution containing metal ion (metal solution) and that supplies the solid electrolyte film with the metal ion. The porous material of the anode includes a porous base material that is insoluble to the metal solution and that is coated with a metal plated film comprising the same metal as the metal coating.

At a position on the opposite side from the base material and facing the anode, a plating anode is disposed via the metal solution which comprises the same metal as the metal coating. To the plating anode and the anode, a plating power supply unit is connected for causing the metal of the plating anode to be deposited on the anode surface via the metal solution.

In the film formation device, the solid electrolyte film is placed in contact with the base material surface, and a voltage is applied between the porous anode and the cathode (base material) by the power supply unit so as to dissolve the metal plated film on the anode. Metal ion from the dissolved metal plated film passes through the solid electrolyte film and is reduced and deposited on the base material surface, whereby a metal coating film can be formed on the base material surface. Even when the metal in the metal plated film is consumed during film formation, the consumed metal can be replenished from the metal of the plating anode by activating the metal the plating power supply unit.

RELATED ART DOCUMENT

Patent Document

Patent Document 1: JP 2014-185371 A

SUMMARY

In the film formation device according to Patent Document 1, during film formation, the metal ion from the metal plated film of the anode is used for metal coating film formation, so that a film of metal coating can be formed on the base material surface in a short time. However, because the metal plated film formed on the anode base material is coated on the porous base material, the metal plated film disappears in a short time. Accordingly, the metal plated film needs to be formed on the anode base material using the plating anode and the plating power supply unit, which requires interruption of the metal coating film formation. In addition, the metal plated film needs to be formed on the base material in such a way that the pores of the anode are not blocked, and it has been difficult to control the film thickness.

The plating anode and the plating power supply unit are used for forming the metal plated film on the anode surface, and are not directly used for metal coating film formation. Installing such member and device makes the configuration of the film formation device more complex.

The present invention was made in view of the above circumstance, and an object of the present invention is to provide a metal coating film formation device and method whereby a film of metal coating can be formed using a simple device configuration and in a short time, and whereby the metal film formation can be performed continuously and for a long period.

In view of the above, a metal coating film formation device according to the present invention includes at least an anode; a solid electrolyte film disposed between the anode and a base material providing a cathode; and a power supply unit that applies a voltage between the anode and the base material. The device is configured to form a film of metal coating on a surface of the base material by applying a voltage between the anode and the base material with the solid electrolyte film being pressed onto the base material, and by reducing a metal ion contained in the solid electrolyte film. The anode is a non-porous anode comprising the same metal as the metal of the metal coating. Between the anode and the solid electrolyte film, a porous material is disposed in contact with the anode and the solid electrolyte film. The porous material includes a plurality of pores providing communication between the anode and the solid electrolyte film and configured to be supplied with a solution containing the metal ion.

According to the present invention, with the plurality of pores of the porous material being supplied with the solution containing the metal ion (hereafter referred to as the "metal solution"), the voltage is applied by the power supply unit between the anode and the base material, whereby the metal of the non-porous anode is eluted into the metal solution in the form of metal ion. The metal ion in the metal solution is supplied to the solid electrolyte film via the pores of the porous material.

The metal ion supplied to the solid electrolyte film moves to the base material surface in contact with the solid electrolyte film, and is reduced on the base material surface, whereby a metal derived from the metal ion is deposited on the base material surface. Thus, a film of metal coating can be formed on the base material surface. When the solid electrolyte film is pressed onto the base material during film formation, the porous material functions as a support member for the solid electrolyte film, so that the solid electrolyte film can be uniformly pressed onto the base material.

Thus, according to the present invention, when the voltage is applied, the metal of the non-porous anode is eluted into the metal solution, and the metal ion from the metal solution can be constantly supplied to the solid electrolyte film. Accordingly, by using the film formation device according to the present invention, compared with when a film of metal coating is formed using the metal ion in the metal solution as the sole film formation raw material and using an insoluble anode, a metal coating film can be formed in a short time.

In the case of the porous anode coated with metal plated film comprising the same metal as the metal coating, as according to conventional art, the metal plated film is dissolved and soon disappears during metal coating film formation. Thus, in order to use the anode continuously for a long period, a device configuration for coating the anode with metal plated film has been necessary. However, according to the present invention, a non-porous anode is used, and the non-porous anode does not readily become depleted compared with the porous anode coated with metal plated film. Thus, the film formation device, with a simple device configuration, can be used for metal coating film formation continuously and for a long period.

The "plurality of pores supplied with the solution containing a metal ion (metal solution)" according to the present invention refers to the pores in a state of being supplied (filled) with the metal solution at least at the time of film formation. Accordingly, the metal solution may be supplied to the pores of the porous material prior to film formation, for example. Alternatively, the pores of the porous material may be supplied with a solvent that dissolves the metal before film formation so that the solvent can cause the metal of the anode to elute, thereby producing a metal solution within the film formation device. The "non-porous anode" according to the present invention refers to an anode having no holes that can be impregnated with a metal-containing solution.

The porous material is not particularly limited as long as the material provides communication between the anode and the solid electrolyte film and includes a plurality of pores to which the metal solution can be supplied. However, in a preferred embodiment, the porous material may comprise a resin material.

Resin material is softer than metal material, so that the porous material comprising resin material can be more readily compressed and deformed than a metal porous material. Thus, when the solid electrolyte film is pressed onto the base material during film formation, the solid electrolyte film can be deformed so as to follow the base material surface. As a result, during film formation, the solid electrolyte film can be uniformly pressed onto the base material surface, whereby a film of metal coating having a uniform film thickness can be formed.

In a preferred embodiment, the film formation device is provided with a bias member disposed on the anode for elastically biasing the anode toward the solid electrolyte film via the porous material. In this embodiment, the anode is elastically biased by the bias member, so that even when the anode becomes depleted by film formation, the contact state between the anode and the porous material and the contact state between the porous material and the solid electrolyte film can be maintained. As a result, even when the metal coating film formation is performed continuously for a long period, the solid electrolyte film can be uniformly pressed onto the base material surface.

In another preferred embodiment, the film formation device is configured to allow the solution (metal solution) to flow in the porous material, and is provided with a circulation mechanism for circulating the solution (metal solution) that flows in the porous material.

In this embodiment, the metal solution can be caused to flow in the porous material in a circulated manner. Of the surfaces of the anode, a portion facing the pores of the porous material is exposed to the metal solution. Thus, the metal solution also flows on the exposed portion in a circulated manner. Accordingly, concentration variations of the metal ion of the metal solution due to the elution of the anode can be reduced, and the concentration of the metal ion contained in the metal solution can be made more uniform, whereby a homogeneous film of metal coating can be formed.

Meanwhile, of the surfaces of the solid electrolyte film, a portion facing the pores of the porous material is also exposed to the metal solution. Thus, the metal solution also flows on the exposed portion in a circulated manner. As a result, the solid electrolyte film can be stably replenished with the metal ion in the metal solution and the solvent. Particularly, by stably supplying the solvent in the solution to the solid electrolyte film, blocking to the movement of the metal ion in the solid electrolyte film can be prevented.

According to the prior art, there is also disclosed a metal coating film formation method. The metal coating film formation method according to the present invention includes disposing a solid electrolyte film between an anode and a base material providing a cathode, pressing the solid electrolyte film onto the base material, applying a voltage between the anode and the base material, and forming a film of metal coating on a surface of the base material by reducing a metal ion contained in the solid electrolyte film. The method further includes using, for the anode, a non-porous anode comprising the same metal as the metal of the metal coating; disposing a porous material between the anode and the solid electrolyte film in contact with the anode and the solid electrolyte film; using, for the porous material, a porous material having a plurality of pores providing communication between the anode and the solid electrolyte film; and forming the film of metal coating by applying the voltage between the anode and the base material, with the plurality of pores being supplied with a solution containing the metal ion.

According to the present invention, when the voltage is applied between the anode and the base material with the plurality of pores being supplied with the metal solution, the metal of the non-porous anode is eluted into the metal solution in the form of a metal ion. The metal ion in the metal solution is supplied to the solid electrolyte film via the pores of the porous material. The metal ion supplied to the solid electrolyte film moves to the base material surface in contact with the solid electrolyte film, and is reduced on the base material surface, whereby a metal derived from the metal ion is deposited on the base material surface. Thus, a film of metal coating can be formed on the base material surface. When the solid electrolyte film is pressed onto the base material during film formation, the porous material functions as a support member for the solid electrolyte film, so that the solid electrolyte film can be uniformly pressed onto the base material.

Thus, according to the present invention, when the voltage is applied, the metal of the non-porous anode is eluted to the metal solution, and the metal ion is constantly supplied to the solid electrolyte film from the metal solution, whereby a film of metal coating can be formed in a short time, as described above. Further, according to the present invention, a non-porous anode is used, as described above. The non-porous anode does not readily become depleted compared with a porous anode, so that the metal coating film formation can be performed continuously for a long period using a simpler device configuration.

In a preferred embodiment, the porous material may comprise a resin material. As described above, a porous material comprising resin material is more readily compressed and deformed than a metal porous material. Thus, during film formation, the solid electrolyte film can be more uniformly pressed onto the base material surface. In this way, a film of metal coating having a uniform film thickness can be formed.

In another preferred embodiment, the metal coating film formation is performed while the anode is elastically biased toward the solid electrolyte film via the porous material. In this embodiment, because the anode is elastically biased toward the solid electrolyte film at the time of film formation, the solid electrolyte film can be uniformly pressed onto the base material surface during film formation regardless of depletion of the anode by film formation, as described above.

In a yet another preferred embodiment, the solution is caused to flow in the porous material, and the metal coating film formation is performed while the solution flowing in the porous material is circulated.

In this embodiment, as described above, concentration variations of the metal ion of the metal solution due to the elution of the anode can be reduced, and the concentration of the metal ion contained in the metal solution can be made more uniform, whereby a homogeneous film of metal coating can be formed. Meanwhile, the solid electrolyte film can be stably replenished with the metal ion in the metal solution and the solvent.

According to the present invention, a film of metal coating can be formed in a short time, and the metal coating film formation can be performed continuously for a long period.

DETAILED DESCRIPTION OF THE EMBODIMENTS

In the following, a film formation device capable of implementing metal coating film formation methods according to three embodiments of the present invention in a preferred manner will be described.

First Embodiment

1-1. Film Formation Device 1A

Figure 1:
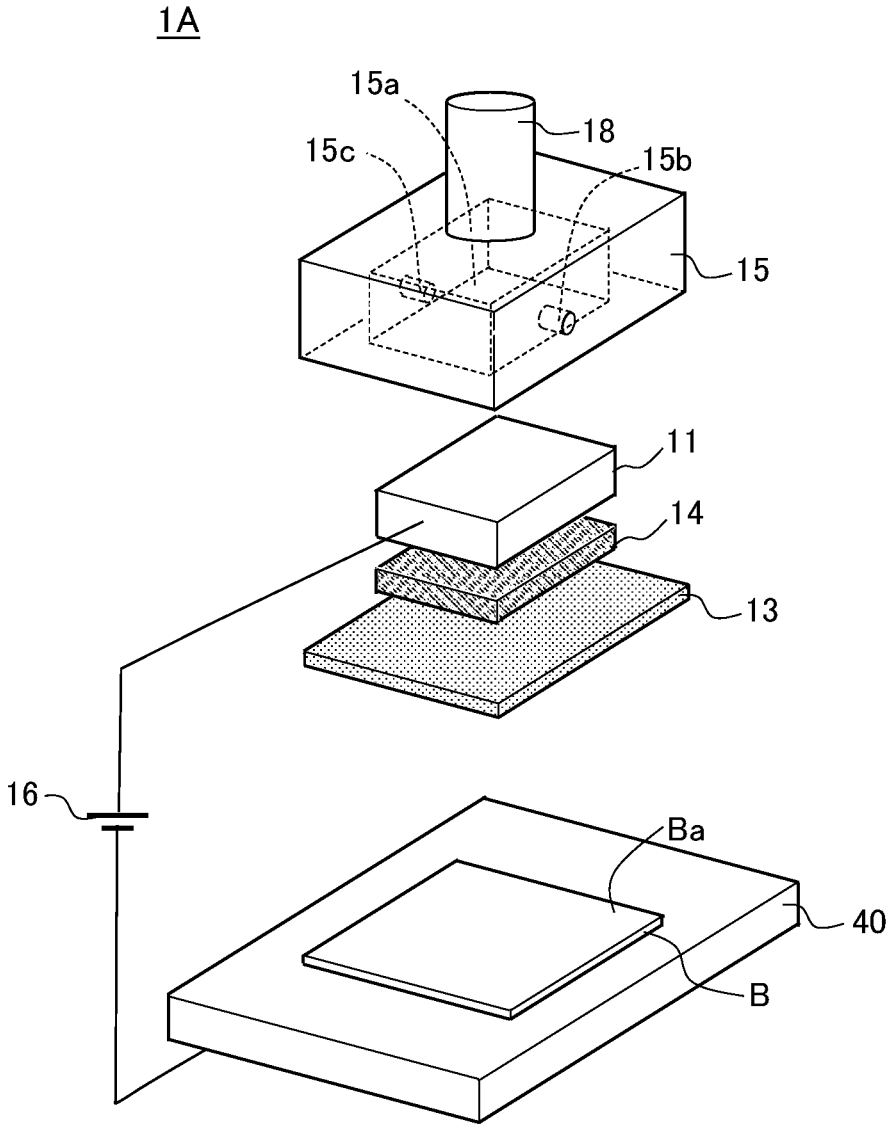
FIG. 1 is a schematic exploded conceptual diagram of a metal coating film formation device according to a first embodiment of the present invention.

FIG. 1 shows a schematic exploded conceptual diagram of a metal coating film formation device 1A according to a first embodiment of the present invention. As illustrated in FIG. 1, the film formation device 1A according to the present invention is a device that causes metal deposition by reducing a metal ion so as to form a film of metal coating F comprising the deposited metal on a surface Ba of a base material B.

The base material B is not particularly limited as long as a surface thereof on which the film is formed can function as a cathode (i.e., as a surface having conductivity). The base material may comprise metal material such as aluminum and iron, or it may comprise a resin or ceramics and the like with a metal layer of copper, nickel, silver, or iron coated on the surface thereof.

The film formation device 1A is provided with a metal anode 11, a solid electrolyte film 13 disposed between the anode 11 and the base material B (cathode), and a power supply unit 16 for applying a voltage between the anode 11 and the base material B.

The present embodiment is provided with a metal mounting base 40 for placing the base material B. To the mounting base 40 is connected the negative electrode of the power supply unit 16, and to the anode 11 is connected the positive electrode of the power supply unit 16. The mounting base 40 and the film formation surface Ba of the base material B are electrically continuous with each other. Thus, the surface Ba of the base material B can be made to function as a cathode. As long as the surface Ba of the base material B can have electrical continuity with the negative electrode of the power supply unit 16, the mounting base 40 may be omitted, and an electrically non-conductive mounting base may be used in place of the mounting base 40.

In the present embodiment, the film formation device 1A is further provided with a porous material 14. The porous material 14 is disposed between the anode 11 and the solid electrolyte film 13 in such a manner as to contact the anode 11 and the solid electrolyte film 13.

More specifically, in the present embodiment, the film formation device 1A is provided with a housing 15. The housing 15 has a housing recess portion 15*a* in a lower part thereof for housing the anode 11 and the porous material 14. With the anode 11 and the porous material 14 housed in the housing recess portion 15*a*, the solid electrolyte film 13 is attached to the bottom surface of the housing 15 so as to seal the housing recess portion 15*a*.

The anode 11 is movable toward the porous material 14 with respect to the housing recess portion 15*a*. Thus, even when the anode 11 is depleted during film formation, the anode 11 can move by its own weight so as to maintain a contact state between the anode 11 and the porous material 14.

According to the present embodiment, the porous material 14 functions as a support member supporting the solid electrolyte film 13 when the base material B is pressed by the solid electrolyte film 13, as will be described later. Thus, the porous material 14 is secured to the housing 15. However, the porous material 14 may be configured to be movable with respect to the housing recess portion 15*a* as is the anode 11 when the base material B is pressed by the solid electrolyte film 13, as long as the base material B can be uniformly pressed by the porous material 14 via the solid electrolyte film 13 using the weight of the anode 11 and the porous material 14 as well as a bias member, which will be described later.

The housing 15 also includes a supply hole 15*b* for supplying a solution L containing metal ion (metal solution) to the porous material 14, and a discharge hole 15*c* for discharging the metal solution from the porous material 14. The supply hole 15*b* and the discharge hole 15*c* are in communication with the housing recess portion 15*a*. The supply hole 15*b* and the discharge hole 15*c* are fitted with sealing material (not shown) so as to prevent the metal solution L from flowing out of the supply hole 15*b* or the discharge hole 15*c* at the time of film formation.

According to the present embodiment, the film formation device 1A is provided with a pressurizing portion 18 disposed on top of the housing 15. The pressurizing portion 18 may include a hydraulic pressure-type or air-type cylinder, for example, and is a device for pressing the solid electrolyte film 13 onto the surface Ba of the base material B. Thus, a film of metal coating can be formed while the surface Ba of the base material B is being pressed by the solid electrolyte film 13.

The anode 11 is a non-porous (or pore-less) anode comprising the same metal as the metal of the metal coating, with a block or plate shape. The porous material 14 has a plurality of pores providing communication between the anode 11 and the solid electrolyte film 13 and being supplied with the metal solution L. According to the present embodiment, the porous material 14 is an isotropic material having a plurality of pores formed so as to permit the passage of the metal solution L from arbitrary directions.

Accordingly, the metal solution L introduced via the supply hole 15*b* impregnates the porous material 14, and the pores of the porous material 14 are supplied and all filled with the metal solution L. After film formation, the porous material 14 may be further supplied with the metal solution L so as to discharge the used metal solution L from the porous material 14 via the discharge hole 15*c*, whereby the porous material 14 can be newly supplied with the metal solution L.

Because the pores provide communication between the anode 11 and the solid electrolyte film 13, the metal solution L supplied to the porous material 14 contacts both the anode 11 and the solid electrolyte film 13. Accordingly, by applying a voltage between the anode 11 and the base material B, the anode 11 can be dissolved, and the metal constituting the anode 11 elutes into the metal solution L in the form of metal ion. The metal ion contained in the metal solution L is supplied to the solid electrolyte film 13.

The porous material 14 is not particularly limited as long as the porous material (1) has corrosion resistance to the metal solution L; (2) can transmit the metal solution L; and (3) can cause the solid electrolyte film 13 to be pressed onto the base material B using the pressurizing portion 18 (i.e., can provide a support for the solid electrolyte film 13).

Examples of the porous material 14 include metal, resin, and ceramics. When the porous material 14 is made of metal, it is preferable to coat a metal foam having high corrosion resistance, such as platinum, iridium oxide, or titanium, with platinum or iridium oxide and the like.

When the porous material 14 is resin, examples of the resin may include resin foams of polytetrafluoroethylene (PTFE) or polyethylene terephthalate (PET). When foam material is used, it is preferable that the foam material has a porosity of 50 to 95 vol %, a pore diameter on the order of 1 to 600 μm, and a thickness on the order of 0.1 to 50 mm.

The solid electrolyte film 13 is not particularly limited as long as it can be impregnated with (i.e., caused to contain) the metal ion by being contacted with the metal solution L, and as long as the metal ion can be reduced by voltage application so that the metal derived from the metal ion can be deposited on the surface Ba of the base material B. Examples of the material of the solid electrolyte film include fluorine-based resin, such as Nafion (registered trademark) manufactured by DuPont; hydrocarbon-based resin; polyamic acid resin; and resin having an ion-exchange function, such as Selemion (CMV, CMD, and CMF series) manufactured by Asahi Glass Co., Ltd.

Alternatively, the metal solution L may include a liquid (electrolytic solution) containing the metal of the metal coating film to be formed in the form of ion. Examples of the metal include copper, nickel, silver, and iron. The metal solution L may be an aqueous solution of such metals dissolved (ionized) by an acid such as nitric acid, phosphoric acid, succinic acid, nickel sulfate, or pyrophosphoric acid. For example, when the metal is nickel, the metal solution L may be an aqueous solution of nickel nitrate, nickel phosphate, nickel succinate, nickel sulfate, or nickel pyrophosphate.

1-2. Film Formation Method Using the Film Formation Device 1A

Figure 2A:
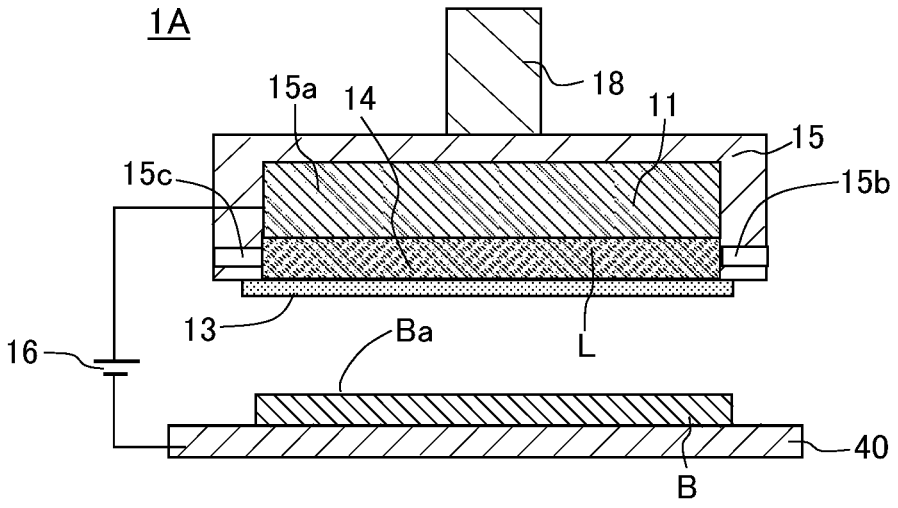
FIG. 2A and FIG. 2B are diagrams for describing a film formation method using the metal coating film formation device illustrated in FIG. 1, FIG. 2A showing a schematic cross section for describing a state of the film formation device prior to film formation, FIG. 2B showing a schematic cross section for describing a state of the film formation device at the time of film formation.
Figure 2B:
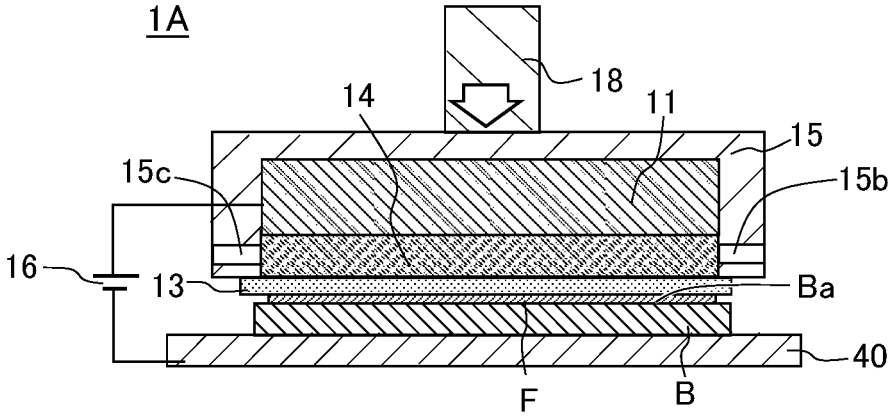

In the following, a film formation method using the film formation device 1A according to the present embodiment will be described. FIG. 2A and FIG. 2B are diagrams for describing the film formation method using the metal coating film formation device 1A illustrated in FIG. 1. FIG. 2A is a schematic cross section for describing a state of the film formation device 1A prior to film formation. FIG. 2B is a schematic cross section for describing a state of the film formation device 1A at the time of film formation.

First, the metal solution L is introduced via the supply hole 15*b*, and the porous material 14 is impregnated with the metal solution L. After impregnation, the supply hole 15*b* and the discharge hole 15*c* are sealed with sealing material (not shown) so as to prevent leakage of the metal solution via the supply hole 15*b* or the discharge hole 15*c*. While herein the metal solution L is used, a solvent that dissolves the metal of the anode 11 (such as an acidic aqueous solution containing an acid mentioned above, such as nitric acid or sulfuric acid) may be introduced so as to produce the metal solution L in the film formation device 1A.

Then, as illustrated in FIG. 2A, the base material B is disposed on the mounting base 40 so as to face the solid electrolyte film 13. Thereafter, as illustrated in FIG. 2B, the housing 15 is lowered toward the mounting base 40 using the pressurizing portion 18 so as to cause the solid electrolyte film 13 to contact the surface Ba of the base material B. Further, the surface Ba of the base material B is pressed by the solid electrolyte film 13.

At this time, when the solid electrolyte film 13 is pressed onto the base material B, the porous material 14 functions as a support member for the solid electrolyte film 13. Thus, the solid electrolyte film 13 can be pressed onto the base material B uniformly. When the porous material 14 comprises resin material, the porous material can be more readily compressed and deformed than when the porous material comprises metal material. Accordingly, the solid electrolyte film 13 can be caused to follow the surface Ba of the base material B, whereby the base material B can be more uniformly pressed by the solid electrolyte film 13. As a result, a film of metal coating F having a uniform film thickness can be formed on the surface Ba of the base material B.

While this pressed state is maintained, and with the pores of the porous material 14 supplied with the metal solution L, a voltage is applied between the anode 11 and the base material B providing the cathode, using the power supply unit 16. Thus, the metal of the non-porous anode 11 is eluted into the metal solution L in the form of metal ion. The metal ion is supplied to the solid electrolyte film 13 via the pores of the porous material 14.

The metal ion supplied to the solid electrolyte film 13 further moves to the surface of the base material B in contact with the solid electrolyte film 13. The metal ion is then reduced on the surface Ba of the base material B, that is the cathode, whereby the metal derived from the metal ion is deposited on the surface Ba of the base material B. In this way, a film of metal coating F can be formed on the surface Ba of the base material B.

Thus, a voltage is applied so as to cause the metal of the non-porous anode 11 to elute into the metal solution L, whereby the metal ion can be constantly supplied to the solid electrolyte film 13 from the metal solution L. Accordingly, compared with when a film of metal coating is formed using the metal ion of the metal solution L as the sole film formation raw material and using an insoluble anode, a film of metal coating F can be formed in a short time.

In the case of the porous anode coated with a metal plated film comprising the same metal as the metal coating, as according to conventional art (such as the technology according to Patent Document 1), the metal plated film is dissolved and soon becomes depleted during metal coating film formation. Consequently, a device configuration has been required for coating the porous anode with the metal plated film. In contrast, according to the present embodiment, the porous material 14 is provided separately from the anode, so that the non-porous anode 11 can be dissolved for film formation.

Thus, because the non-porous anode 11 has a higher density of metal as a metal ion supply source than a porous anode, the anode 11 does not readily become depleted even if film formation is conducted continuously over a long period. Accordingly, the film formation device 1A according to the present embodiment can be used for forming the film of metal coating F continuously and for a long period in a simpler device configuration than a conventional configuration.

Second Embodiment

2-1. Film Formation Device 1B

Figure 3:
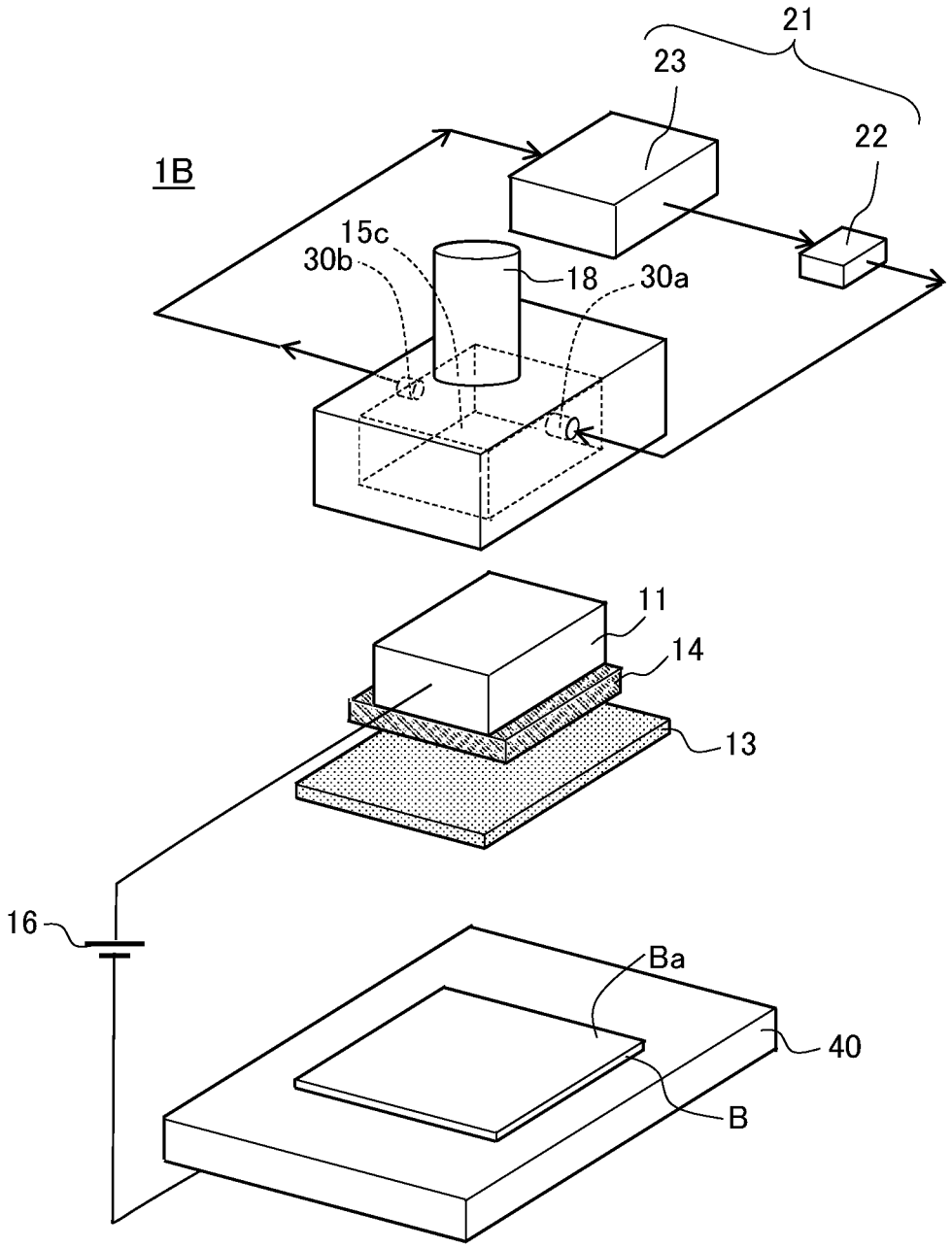
FIG. 3 is a schematic exploded conceptual diagram of a metal coating film formation device according to a second embodiment of the present invention.
Figure 4:
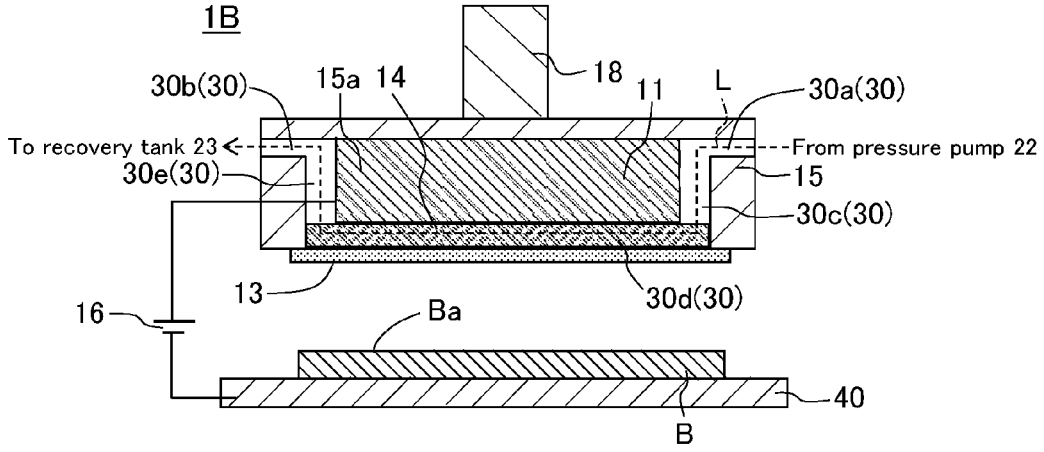
FIG. 4 is a schematic cross section of the film formation device illustrated in FIG. 3.

FIG. 3 is a schematic exploded conceptual diagram of a metal coating film formation device 1B according to a second embodiment of the present invention. FIG. 4 shows a schematic cross section of the film formation device 1B illustrated in FIG. 3. The second embodiment differs from the first embodiment in that the film formation device 1B includes a flow passageway 30 for the flow of the metal solution L, and that the metal solution L flowing through the flow passageway 30 is circulated. Accordingly, configurations common to those of the first embodiment are designated with similar signs, and their detailed description will be omitted.

As illustrated in FIG. 3 and FIG. 4, in the film formation device 1B according to the second embodiment, the flow passageway 30 is formed for the flow of the metal solution L in the porous material 14. Specifically, in the housing 15, the flow passageway 30 includes a supply flow passageway 30*a* for supplying the metal solution L into the housing 15, and a discharge flow passageway 30*b* for discharging the metal solution L supplied into the housing 15 to the outside.

The supply flow passageway 30*a* communicates with an upstream-side gap 30*c* formed between an inner wall on one side of the housing recess portion 15*a* and the anode 11. The upstream-side gap 30*c* constitutes a part of the flow passageway 30 for the flow of the metal solution L toward the porous material 14. The metal solution L that flows in the upstream-side gap 30*c* is guided to the porous material 14 disposed between the anode 11 and the solid electrolyte film 13.

The porous material 14 is disposed between the anode 11 and the solid electrolyte film 13 in such a manner as to be in contact therewith, as in the first embodiment. According to the present embodiment, a space 30*d* formed between the anode 11 and the solid electrolyte film 13 constitutes a part of the flow passageway 30 through which the metal solution L flows, with the porous material 14 disposed in the flow passageway 30.

Accordingly, the metal solution L guided to the porous material 14 passes through and flows inside the porous material 14 (specifically, the plurality of pores of the porous material 14) while making contact with the anode 11 and the solid electrolyte film 13. The metal solution L that has flowed inside the porous material 14 flows in a downstream-side gap 30*e* formed between an inner wall on the other side of the housing recess portion 15*a* and the anode 11, and is discharged via the discharge flow passageway 30*b*. According to the present embodiment, in a direction perpendicular to the drawing sheet of FIG. 4, the anode 11 is movably in contact with the inner walls of the housing recess portion 15*a* so that the metal solution L will not flow between the anode and the inner walls of the housing recess portion 15*a*.

The supply flow passageway 30*a* and the discharge flow passageway 30*b* are connected to a circulation mechanism 21 via piping. The circulation mechanism 21 is provided with a pressure pump 22 for pumping the metal solution L to the supply flow passageway 30*a*, and a recovery tank 23 for collecting the metal solution L discharged out of the discharge flow passageway 30*b*. The pressure pump 22 is connected to the recovery tank 23, and the metal solution L collected in the recovery tank 23 is pumped into the supply flow passageway 30*a*. In this way, the metal solution L that flows in the porous material 14 can be circulated.

2-2. Film Formation Method Using the Film Formation Device 1B

Figure 5:
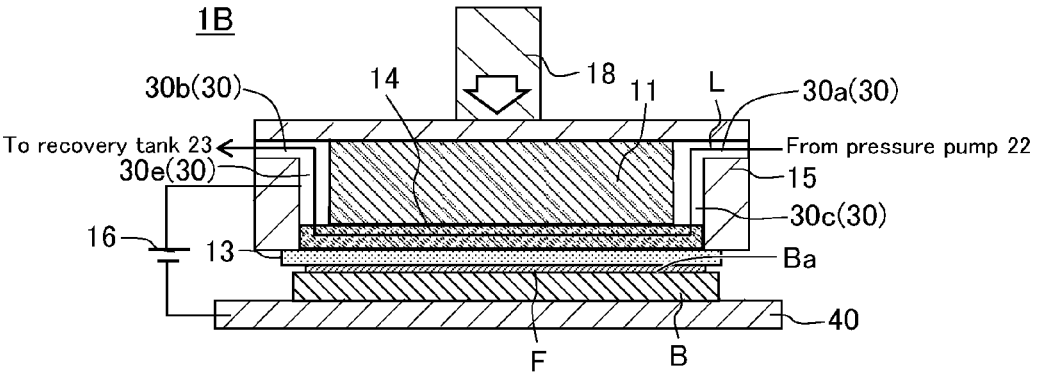
FIG. 5 is a schematic cross section for describing a state of the film formation device illustrated in FIG. 4 at the time of film formation.

In the following, a film formation method using the film formation device 1B according to the present embodiment will be described. FIG. 5 is a schematic cross section for describing the state of the film formation device 1B illustrated in FIG. 4 at the time of film formation.

First, as illustrated in the above-described FIGS. 3 and 4, the base material B is disposed on the mounting base 40 so as to face the solid electrolyte film 13. Then, as illustrated in FIG. 5, the housing 15 is lowered toward the mounting base 40 using the pressurizing portion 18, and the solid electrolyte film 13 is contacted with the surface Ba of the base material B. Further, the surface Ba of the base material B is pressed by the solid electrolyte film 13.

While the pressed state is maintained, the metal solution L in the recovery tank 23 is pumped toward the supply flow passageway 30*a* using the pressure pump 22 so as to cause the metal solution L to flow in the flow passageway 30. Thus, the metal solution L flows in the porous material 14 disposed between the anode 11 and the solid electrolyte film 13, and the metal solution L that has flowed therebetween (i.e., in the flow passageway 30) can be circulated. While the metal solution L is thus circulated, a voltage is applied between the anode 11 and the base material B using the power supply unit 16, whereby a film of metal coating F is formed on the surface Ba of the base material B.

According to the present embodiment, in addition to the effect of the film formation device 1A according to the first embodiment, the following additional effect can be expected. According to the present embodiment, the flow passageway 30 is formed so as to allow the metal solution L to flow in the porous material 14, and the metal solution L flowing in the flow passageway 30 is circulated by the circulation mechanism 21. Thus, the metal solution L can be caused to flow in a circulated manner in the porous material 14 disposed in the circulated flow passageway 30.

Of the surfaces of the anode 11, the portion facing the pores of the porous material 14 is exposed to the metal solution L, the exposed portion constituting a part of the wall surfaces forming the flow passageway 30. Accordingly, the metal solution L also flows on the wall surface in a circulated manner. Thus, concentration variations of the metal ion of the metal solution L due to the elution of the anode 11 at the time of film formation can be reduced, and the concentration of the metal ion contained in the metal solution L can be made more uniform, whereby a homogeneous metal coating F can be formed.

Of the surfaces of the solid electrolyte film 13, the portion facing the pores of the porous material 14 is also exposed to the metal solution L. Thus, the exposed portion constitutes a part of the wall surfaces forming the flow passageway. The metal solution L also flows on the wall surface in a circulated manner. Thus, the solid electrolyte film 13 can be stably replenished with the metal ion in the metal solution. Particularly, by stably supplying the solid electrolyte film 13 with the moisture in the metal solution, the moisture content of the solid electrolyte film 13 is stabilized, whereby the blocking of movement of the metal ion in the solid electrolyte film 13 can be prevented.

Third Embodiment

Figure 6A:
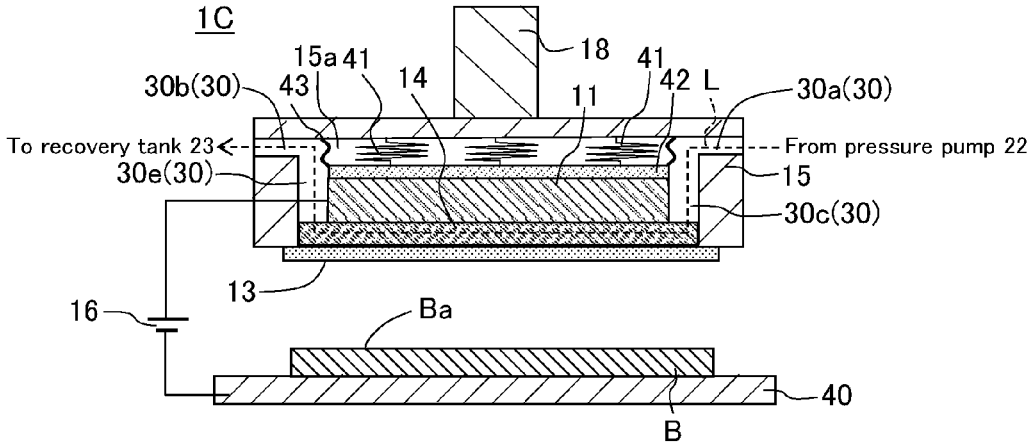
FIG. 6A is a diagram for describing a metal coating film formation device according to a third embodiment, FIG. 6B showing a schematic cross section for describing a state of the film formation device at the time of film formation, FIG. 6C showing a schematic cross section for describing a state after the film formation device has been used following the state of FIG. 6B.
Figure 6B:
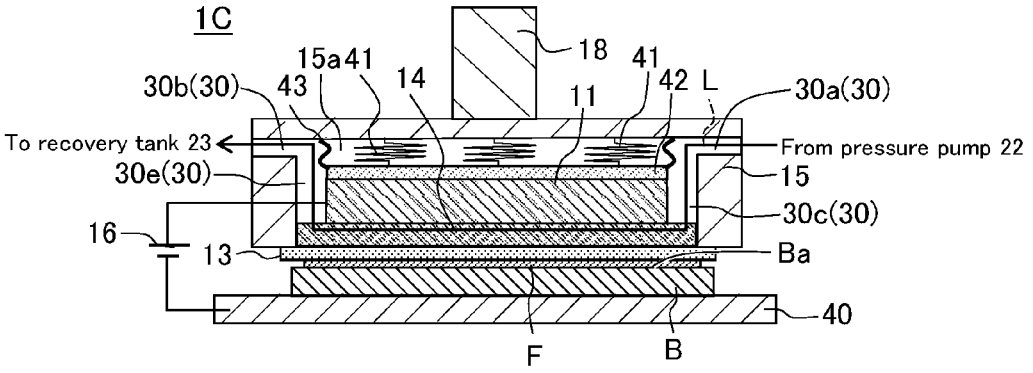
Figure 6C:
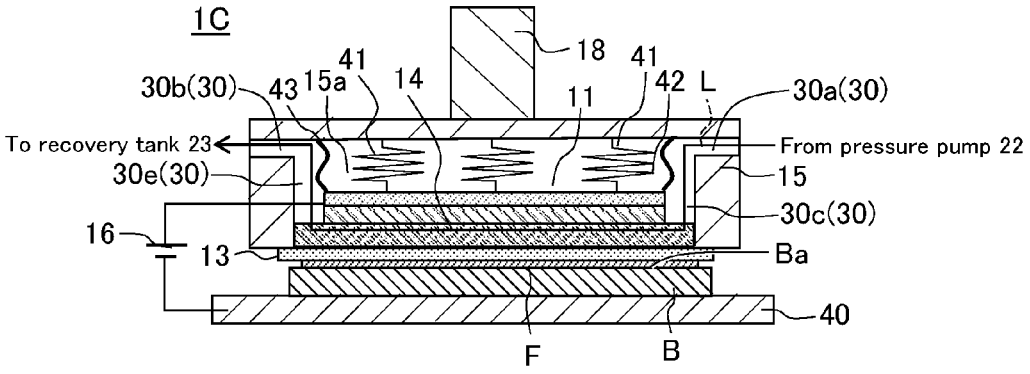

FIG. 6A is a diagram for describing a metal coating film formation device 1C according to a third embodiment. FIG. 6B is a schematic cross section for describing the state of the film formation device 1C at the time of film formation. FIG. 6C is a schematic cross section for describing the state after use of the film formation device 1C from the state of FIG. 6B.

The film formation device 1C according to the third embodiment differs from the second embodiment in that the device is fitted with a structure for elastically biasing the anode 11 toward the solid electrolyte film 13. Accordingly, configurations common to those of the second embodiment are designated with similar signs, and their detailed description will be omitted.

As illustrated in FIG. 6A, the film formation device 1C according to the present embodiment is provided with a plurality of spring members (bias members) 41 for elastically biasing the anode 11 toward the solid electrolyte film 13 via the porous material 14. The spring members 41 are disposed in the housing recess portion 15*a* of the housing 15 in a compressively deformed state, biasing the anode 11 via a pressing plate 42.

Further, in order to isolate the spring members 41 from the flow passageway 30 in which the metal solution L flows, sealing material 43 is attached between the pressing plate 42 and the inner walls of the housing recess portion 15*a*. The shape of the sealing material 43 is flexible depending on the interval between the pressing plate 42 and the inner walls of the housing recess portion 15*a*.

According to the present embodiment, the anode 11 is elastically biased by the spring members 41. Thus, even when the anode 11 becomes depleted by film formation to the state of FIG. 6C from FIG. 6B, for example, the contact state between the anode 11 and the porous material 14, and the contact state between the porous material 14 and the solid electrolyte film 13 can be maintained. As a result, even if a film of the metal coating F is formed continuously for a long period, the solid electrolyte film 13 can be uniformly pressed onto the surface Ba of the base material B.

While in the present embodiment the bias member is provided by the spring members 41, the bias member may include elastic material, such as rubber or resin foam, as long as the anode 11 can be elastically biased toward the solid electrolyte film 13 via the porous material 14.

Further, while the present embodiment employs the spring members 41, a fastening member such as a bolt may be fitted on top of the housing 15 so as to move the anode 11 toward the porous material 14. In this way, the fastening member can be fastened to move the anode 11 toward the porous material 14 as the anode 11 is depleted, whereby the contact state between the anode 11 and the porous material 14, and the contact state between the porous material 14 and the solid electrolyte film 13 can be ensured.

EXAMPLE

The present invention will be described with reference to the following Example.

Example

A film of metal coating was formed using the film formation device according to the second embodiment illustrated in FIG. 4. First, a glass plate (50 mm×50 mm×thickness 1 mm) was prepared, and gold was sputtered on a surface thereof, fabricating a base material with gold coating. Then, as the metal solution, 1.0 mol/L of copper sulfate aqueous solution was prepared. For the anode, a non-porous soluble anode was used. For the soluble anode, an oxygenfree copper plate (30 mm×30 mm×thickness 1 mm) was prepared. For the porous material, a titanium foam plate (30 mm×30 mm×thickness 0.5 mm (manufactured by Mitsubishi Materials Corporation)) having a porosity of 85% and a pore diameter of 50 μm was used. For the solid electrolyte film, an electrolyte film (manufactured by DuPont: Nafion N117) having a film thickness of 183 μm was used.

Then, the gold coating of the base material was placed in electrical conduction with the negative electrode of the power supply unit, and, while the ion solution was being supplied between the anode and the solid electrolyte film at the rate of 15 ml/min, a voltage was applied between the anode and the base material as the solid electrolyte film was pressed onto the base material surface at 0.5 MPa, whereby a copper coating film was formed on the gold coated surface of the base material.

Figure 7:
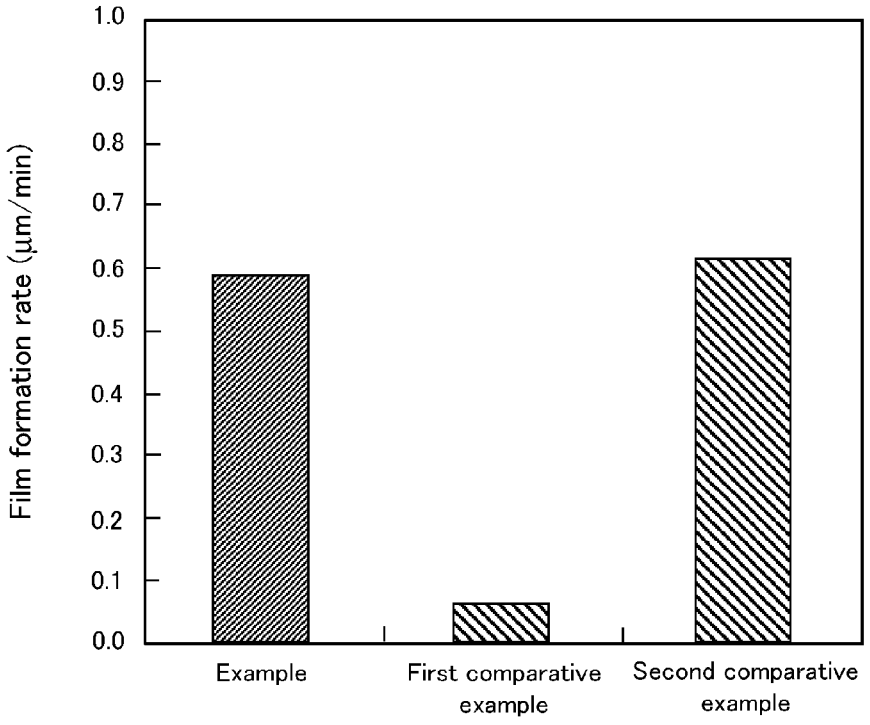
FIG. 7 is a diagram illustrating the result concerning the metal coating film formation rate in a case where the film formation devices according to an Example and first and second comparative examples were used.

The current density was increased to a limit current density such that no film formation defect was caused in the copper coating, so as to achieve a target film thickness of 10 μm for the film of copper coating being formed, and the film formation time for the copper coating film was measured. The mass of the base material before and after film formation was measured so as to calculate the mass of the copper coating from a mass difference, and the film thickness of the copper coating was calculated. From the film thickness and the film formation time of the copper coating, the film formation rate of the copper coating was calculated. The results are shown in Table 1 and FIG. 7.

First Comparative Example

As in the Example, a film of copper coating was formed. The first comparative example differed from the Example in that the porous material was not used and that, instead of the non-porous soluble anode, a porous insoluble anode was used for forming a film of copper coating. Specifically, the porous insoluble anode was prepared by coating a titanium foam plate measuring 30 mm×30 mm×thickness 2.5 mm with a platinum plated film. The porous insoluble anode was contacted with the solid electrolyte film, and, with the solid electrolyte film being pressed onto the base material, a copper sulfate aqueous solution was supplied into the anode under the same condition as in the Example, and a copper coating film was formed while a voltage was being applied between the anode and the base material. As in the Example, the limit current density was measured, and the film formation rate of the copper coating was calculated. The results are shown in Table 1 and FIG. 7.

Second Comparative Example

As in the Example, a film of copper coating was formed. The second comparative example differed from the Example in that the porous material was not used, and that instead of the non-porous soluble anode, a porous soluble anode was used to form a film of copper coating. Specifically, the porous soluble anode was prepared by coating a titanium foam plate measuring 30 mm×30 mm×thickness 2.5 mm with copper plated film. The porous soluble anode was contacted with the solid electrolyte film, and, with the solid electrolyte film being pressed onto the base material, a copper sulfate aqueous solution was supplied into the anode under the same condition as in the Example, and a copper coating film was formed while a voltage was applied between the anode and the base material. As in the Example, the limit current density was measured, and the film formation rate of the copper coating was calculated. The results are shown in Table 1 and FIG. 7.

TABLE 1

| | Example | First comparative example | Second comparative example |
|---|---|---|---|
| Limit current density (mA/cm$^2$) | 26.67 | 3.33 | 26.67 |
| Film formation rate (μm/min) | 0.59 | 0.07 | 0.61 |

Results

When the film formation device according to the Example was used, compared with the first comparative example, the copper coating film formation rate increased. This is because, in the case of the first comparative example, the sole metal supply source for the copper coating film formation was the copper of the copper sulfate aqueous solution, whereas in the case of the Example, the supply source included the copper of the anode in addition to the copper of the copper sulfate aqueous solution.

When the film formation device according to the second comparative example was used, the copper coating film formation rate was equivalent to that of the Example. However, because the anode of the second comparative example is a soluble anode comprising a titanium foam plate coated with copper plated film, film formation cannot be performed when the copper plated film becomes depleted. In contrast, the anode of the Example is a non-porous soluble anode, so that a film of metal coating can be formed for a long period.

While the present invention has been described with reference to the embodiments, it should be noted that the present invention is not limited to the embodiments, and that various design modifications may be made without departing from the scope and spirit of the present invention set forth in the claims.

In the film formation device according to the first embodiment, the metal solution was supplied to the porous material intermittently prior to film formation. However, the metal solution may be continuously caused to flow through a flow passageway provided by the supply hole, the space in which the porous material was disposed, and the discharge hole, using the pressure pump during film formation.

What is claimed is:

1. A metal coating film formation device comprising at least:

an anode;

a solid electrolyte film disposed between the anode and a base material providing a cathode; and a power supply unit that applies a voltage between the anode and the base material, the device being configured to form a film of metal coating on a surface of the base material by applying the voltage between the anode and the base material with the solid electrolyte film being pressed onto the base material, and by reducing a metal ion contained in the solid electrolyte film, wherein the anode is a non-porous anode comprising the same metal as the metal of the metal coating, between the anode and the solid electrolyte film, a porous material is disposed in contact with the anode and the solid electrolyte film, and the porous material includes a plurality of pores providing communication between the anode and the solid electrolyte film and configured to be supplied with a solution containing the metal ion.

2. The metal coating film formation device according to claim 1, wherein the porous material comprises a resin material.

3. The metal coating film formation device according to claim 1, comprising a bias member disposed on the anode that elastically biases the anode toward the solid electrolyte film via the porous material.

4. The metal coating film formation device according to claim 1, wherein the film formation device is configured to allow the solution to flow in the porous material, the film formation device comprising a circulation mechanism that circulates the solution that flows in the porous material.

5. A metal coating film formation method comprising disposing a solid electrolyte film between an anode and a base material providing a cathode, pressing the solid electrolyte film onto the base material, applying a voltage between the anode and the base material, and form a film of metal coating on a surface of the base material by reducing a metal ion contained in the solid electrolyte film, the method further comprising:

using, for the anode, a non-porous anode comprising the same metal as the metal of the metal coating;

disposing a porous material between the anode and the solid electrolyte film in contact with the anode and the solid electrolyte film;

using, for the porous material, a porous material having a plurality of pores providing communication between the anode and the solid electrolyte film; and forming the film of metal coating by applying the voltage between the anode and the base material, with the plurality of pores being supplied with a solution containing the metal ion.

6. The metal coating film formation method according to claim 5, wherein the porous material comprises a resin material.

7. The metal coating film formation method according to claim 5, comprising performing the forming of the film of metal coating while the anode is elastically biased toward the solid electrolyte film via the porous material.

8. The metal coating film formation method according to claim 5, comprising causing the solution to flow in the porous material, and performing the forming of the metal coating film while the solution flowing in the porous material is circulated.

* * * * *